US007141762B2

(12) United States Patent
Iltis et al.

(10) Patent No.: US 7,141,762 B2
(45) Date of Patent: Nov. 28, 2006

(54) SYSTEM AND METHOD FOR INFORMATION HANDLING SYSTEM PERIPHERAL HEATING ELEMENT THERMAL FAILSAFE

(75) Inventors: Wayne Iltis, Austin, TX (US); Donald Guthan, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 11/225,338

(22) Filed: Sep. 13, 2005

(65) Prior Publication Data

US 2006/0006161 A1 Jan. 12, 2006

Related U.S. Application Data

(63) Continuation of application No. 10/841,203, filed on May 7, 2004, now Pat. No. 6,967,308.

(51) Int. Cl.
*H05B 1/00* (2006.01)

(52) U.S. Cl. ..... 219/216; 219/469; 219/494; 29/611; 313/578

(58) Field of Classification Search ..... 219/216, 219/469, 471, 494; 29/611, 612; 313/56, 313/318.08, 491, 578; 399/33, 69, 328, 330, 399/791

See application file for complete search history.

(56) References Cited

U.S. PATENT DOCUMENTS

| | | | | |
|---|---|---|---|---|
| 2,104,861 | A * | 1/1938 | Gannett | 315/107 |
| 3,105,182 | A * | 9/1963 | Koppel et al. | 318/446 |
| 5,105,064 | A | 4/1992 | Kresock | 219/216 |
| 5,659,222 | A * | 8/1997 | Ragsdale et al. | 313/578 |
| 5,977,692 | A | 11/1999 | Itaya et al. | 313/37 |
| 6,297,585 | B1 | 10/2001 | Tashiro et al. | 313/318.08 |
| 6,911,625 | B1 * | 6/2005 | Shimonaka | 219/216 |
| 6,967,308 | B1 * | 11/2005 | Iltis et al. | 219/216 |

* cited by examiner

*Primary Examiner*—Robin Evans
*Assistant Examiner*—Leonid M. Fastovsky
(74) *Attorney, Agent, or Firm*—Hamilton & Terrile, LLP; Robert W. Holland

(57) ABSTRACT

Information handling system peripherals that use a heating element are protected from catastrophic failure due to overheating by a thermal failsafe associated with the heating element that fails the heating element if excessive temperatures are reached. For instance, the failsafe releases the vacuum from a heating element bulb so that the application of power to the filament of the heating element bulb oxidizes the filament resulting in failure of the filament and ceasing of generation of heat. The failsafe includes a melting agent, such as wax or solder, which seals an opening in the bulb unless a thermal runaway temperature is reached in excess of a desired operating temperature. Alternatively, the failsafe includes an expanding agent, such as a ceramic or a liquid-filled bubble, which releases the vacuum by fracturing an opening in the bulb at the thermal runaway temperature. The thermal runaway temperature is selected to induce failure before catastrophic overheating of the peripheral.

12 Claims, 2 Drawing Sheets

SYSTEM AND METHOD FOR INFORMATION HANDLING SYSTEM PERIPHERAL HEATING ELEMENT THERMAL FAILSAFE

This application is a continuation of application Ser. No. 10/841,203, filed May 7, 2004, now U.S. Pat. No. 6,967,308, entitled System and Method for Information Handling System Peripheral Heating Element Thermal Failsafe naming Wayne Iltis and Donald Guthan as inventors, which is hereby incorporated by reference in its entirety.

BACKGROUND OF THE INVENTION

1. Field of the Invention

The present invention relates in general to the field of information handling system peripherals, and more particularly to a system and method for an information handling system printer heating element thermal fuse.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems often interact with a number of peripherals to communicate, print or otherwise process information. For instance, ink jet and laser printers are typically used to print information, such as documents and photographs. Printers often include heating elements that supply heat during the printing process. For example, laser printers generally include a heating element within a printing drum to heat the printing drum so that toner affixes to paper pressed against the printing drum. The heating element is generally enclosed in a vacuum formed in a bulb, similar to a light bulb, so that the element does not oxidize and thus fail. A temperature controller selectively applies power to the heating element in order to maintain the printing drum in a desired temperature range. Insufficient heating of the printing drum will result in failed or suboptimal transfer of toner to paper that contacts the drum. Excessive heating of the printing drum will result in the failure of printer components and, possibly, a fire hazard if heat from the printing drum is sufficient to light the paper or other combustible material on fire. Other types of information handling system peripherals also use similar vacuum-enclosed heating elements for generating heat due to their simplicity and responsiveness.

One difficulty that arises with heating elements occurs if the temperature controller fails in a state that has power applied to the heating element. When left uncontrolled in the on position, heating elements typically overheat in a rapid manner resulting in catastrophic damage. A number of different types of safety devices are sometimes used in order to prevent overheating from excessive power applied to a heating element, such as those commonly found in laser printers. For instance, temperature sensors located near the heating element sense when an excessive temperature is reached, such as in the event of a failure of a temperature controller, and turn off power to the heating element. However, such electrical failsafe sensors are themselves subject to failure, such as by inadvertent bypassing of the sensor, incorrect installation of the sensor or outright sensor failure. Some non-electrical systems warn of overheating with visual indications, such as by displaying a color change with material that melts or is otherwise temperature sensitive above a certain temperature range. However, in order for such visual warning systems to work, a user must generally detect the warning and react to the overheating condition before damage occurs. Other types of safety systems attempt to respond to the fire risk that arises in overheating conditions by releasing fire retardant, such as halogen released by the breaking of a glass vial once a certain temperature is exceeded. However, fire retardants do not directly address reducing the heat generated by the light and often initiate only after catastrophic failure.

SUMMARY OF THE INVENTION

Therefore a need has arisen for a system and method which automatically shuts down a heating element in the event of an over temperature.

In accordance with the present invention, a system and method are provided which substantially reduce the disadvantages and problems associated with previous methods and systems for detecting and correcting the overheating of a vacuum-enclosed heating element. A failsafe integrated with the heating element fails the heating element at a predetermined temperature by releasing the vacuum from within the bulb to prevent generation of heat. Activation of the failsafe occurs with heat that exceeds the operating temperature associated with a device that uses the heating element and seeks to fail the heating element before heat damage occurs to the device.

More specifically, an information handling system peripheral, such as a laser printer uses a heating element to generate an operating temperature associated with transfer by a printing drum of printing material, such as toner, to a print media, such as paper. A temperature controller intermittently applies power to the heating element to maintain the operating temperature. In the event of inadvertent over heating by the temperature controller to a predetermined degree in excess of the operating temperature, a failsafe integrated in the heating element activates to fail the heating element and thus prevent generation of heat. For instance, a melting agent, such as solder or wax, integrated in the evacuation port of the heating element melts at the predetermined over temperature to release the vacuum from the heating element and thus preclude the filament within the heating element from generating heat. Alternatively, an expanding agent, such as a ceramic or a gas or liquid bubble, integrated in the evacuation port of the heating element expands to fracture the heating element at the predetermined over temperature to release the vacuum from the heating element and thus preclude the filament within the heating element from generating heat.

The present invention provides a number of important technical advantages. One example of an important technical advantage is that over temperature of a heating element is automatically detected and corrected with a temperature-induced failure of the vacuum within the heating element bulb to oxidize and fail the heating element. The over-temperature induced failure mechanism is integrated within the heating element so that failsafe protection does not depend on proper installation and operation of separate systems within an information handling system peripheral. The failure temperature is selectable in the design of the heating element to prevent catastrophic failure within the peripheral.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Information handling system peripherals that use heating elements, such as laser printers, are protected from catastrophic failure due to thermal runaway of the heating element with an over temperature induced failure of the heating element by an integrated failsafe. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
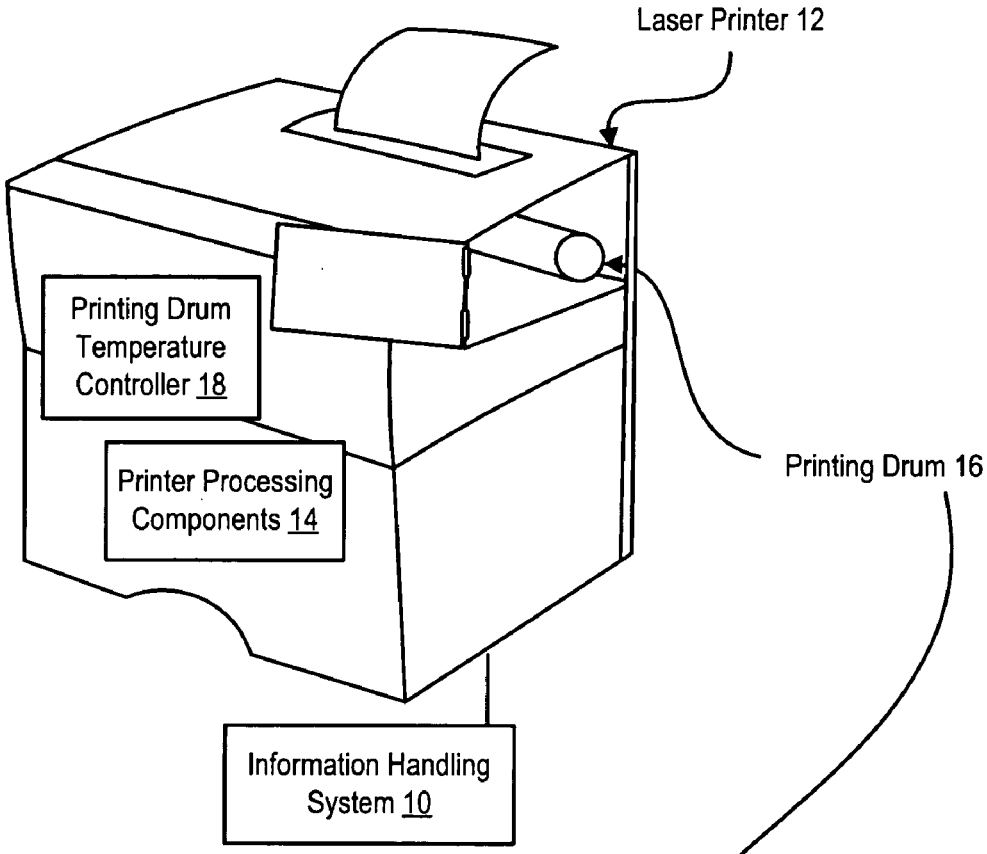
FIG. 1 depicts a block diagram of an information handling system interfaced with a laser printer.

Referring now to FIG. 1, a block diagram depicts an information handling system 10 interfaced with a laser printer 12. Information handling system 10 processes information for printing, such as documents or pictures, and communicates the information to laser printer 12, such as over a USB cable. Printer processing components 14 associated with laser printer 12 accepts the information from information handling system 10 and prepares the information for transfer to print media, such as paper, by affixing print material to the print media, such as toner. The information is affixed to the print media at a printing drum 16, which rotates to move the paper through the printer. In order to affix toner to paper, printing drum 16 is heated by an internal heating device that is controlled by a printing drum temperature controller 18. On initial power up of laser printer 12, printing drum temperature controller 18 commands the generation of heat until a desired operating temperature is achieved and thereafter intermittently commands the generation of heat to maintain the operating temperature without creating an over temperature condition by commanding excessive heat generation. Generally, the greater the heat generating capability of a laser printer drum heating device the better the response time of the laser printer to a print request from a powered down condition and the greater the risk of damage if a runaway heating device creates an over temperature condition.

Figure 2:
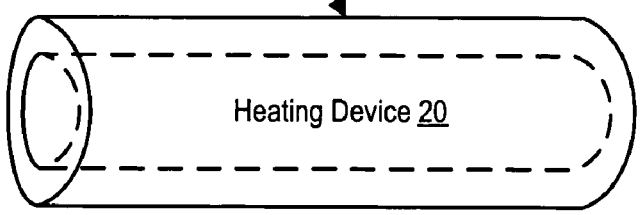
FIG. 2 depicts a blown-up view of the laser printer's printing drum and heating device.
Figure 3:
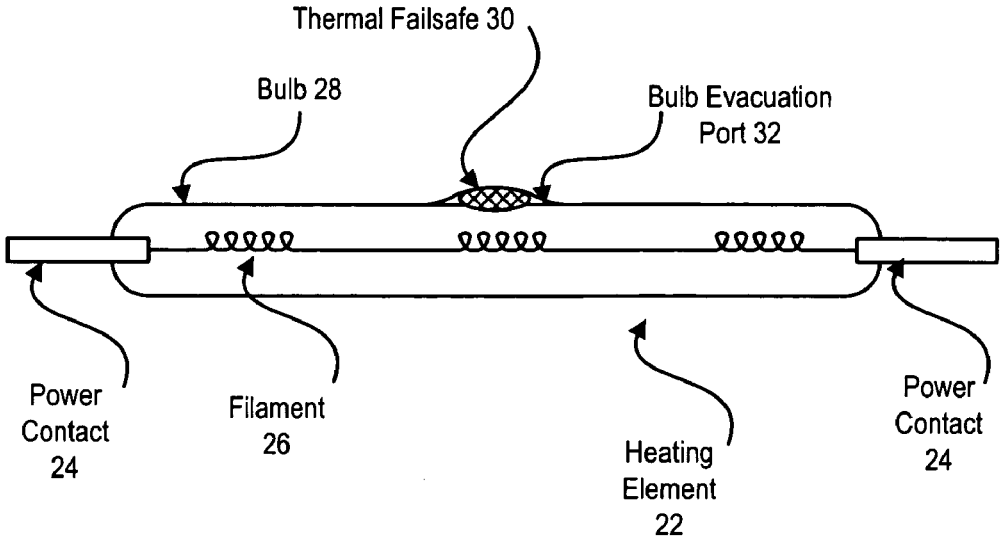
FIG. 3 depicts a side view of a failsafe heating element that inserts into the printing drum heating device.

Referring now to FIG. 2, a heating device 20 is depicted disposed within the interior of printing drum 16. Heating device 20 is a cylindrical metal tube that inserts into an opening of printing drum 16 and accepts electrical power applied by printing drum temperature controller 18 to generate heat with an internal heating element. FIG. 3 depicts a heating element 22 that inserts into heating device 20 to generate heat. Heating element 22 is essentially a light bulb that accepts electrical power through power contacts 24 but that generates heat rather than light by running current through a filament 26 maintained in a vacuum by a bulb 28. Heating element 22 is made of rugged components that will withstand multiple intermittent applications of power in a high temperature-operating environment, however, failure of the vacuum leads to rapid failure of the filament due to oxidation introduced via the atmosphere external to the bulb.

Figure 4:
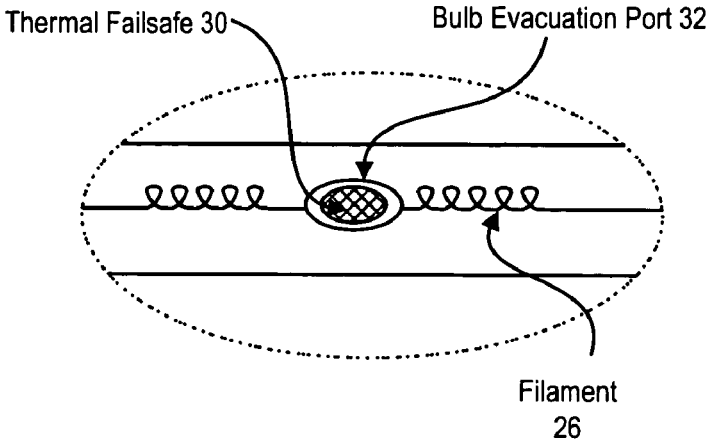
FIG. 4 depict a top view of a thermal failsafe integrated in the evacuation port of a heating element bulb.

As depicted by FIGS. 3 and 4, heating element 22 includes a thermal failsafe 30 that maintains the vacuum within bulb 28 but that releases the vacuum from bulb 28 if an excessive temperature is reached, thus inducing a failure of heating element 22. For instance, thermal failsafe 30 is a melting agent or an expanding agent inserted in an evacuation port 32 of bulb 28 during manufacture of heating element 22. Evacuation port 32 is the point on the surface of bulb 28 from which a vacuum is created at manufacture by removing air from within bulb 28. Instead of sealing evacuation port 32 with melted bulb material after the vacuum is created, a melting agent or expanding agent is used that will induce failure of the vacuum within bulb 28 at a predetermined temperature. For instance, melting agents include solder or wax which maintain a solid state at the operating temperature to seal evacuation port 32 and melt at a predetermined thermal runaway temperature to release the vacuum from within bulb 28. Expanding agents include a ceramic material or a liquid or gas bubble integrated within bulb 28 that expand to fracture bulb 28 at the predetermined thermal runaway temperature, thus releasing the vacuum. Although evacuation port 32 is a convenient location for placement of thermal failsafe 30, other placements along bulb 28 or contacts 24 may be used that have access to release the vacuum.

In operation, thermal failsafe 30 does not activate or otherwise impede heat generation by heating element 22 within normal operating temperatures. However, in the event of a malfunction of printer drum temperature controller 18 that increases the heat generation by heating element 22 to an excessive level, thermal failsafe 30 activates to fail heating element 22 before catastrophic damage occurs to laser printer 12. The activation temperature of failsafe 20 is selectable by the type of melting or expanding agent used so that inadvertent failures of heating element 22 are avoided by too low of a failsafe temperature while damage to the peripheral is prevented by too high of a failsafe temperature. Generally, the activation temperature is selected as a temperature differential of a predetermined amount over the operating temperature of the peripheral. Thus, in different types of information handling system peripherals, varying failsafe activation temperatures may be selected based on the operating temperature and the sensitivity of the peripheral to heat damage.

Although the present invention has been described in detail, it should be understood that various changes, substitutions and alterations can be made hereto without departing from the spirit and scope of the invention as defined by the appended claims.

The invention claimed is:

1. A heating element for generating an operating temperature through intermittent applications of power, the heating element comprising:

first and second electrical contacts operable to accept the intermittent applications of power;

a filament disposed between the electrical contacts, the filament operable to generate heat upon application of power in a vacuum;

a bulb enclosing the filament within the vacuum; and a thermal failsafe operable to release the vacuum at a predetermined thermal runaway temperature.

2. The heating element of claim 1 wherein the thermal failsafe comprises a melting agent disposed proximate the bulb, the melting agent having a solid state at the operating temperature that retains the vacuum in the bulb and a liquid state at the thermal runaway temperature that releases the vacuum from the bulb.

3. The heating element of claim 1 wherein the thermal failsafe comprises an expanding agent disposed proximate the bulb, the expanding agent having a first state at the operating temperature that retains the vacuum in the bulb and a second state at the thermal runaway temperature that releases the vacuum from the bulb.

4. The heating element of claim 1 wherein the second state of the expanding agent comprises an expanded size that fractures the bulb to release the vacuum.

5. The heating element of claim 1 wherein the first and second contacts are operable to interface with an information handling system peripheral.

6. The heating element of claim 5 wherein the information handling system peripheral comprises a laser printer having a printer drum and the contacts interface with the printer drum.

7. A failsafe method for generating heat, the method comprising:

applying power to a heating element to generate heat;

sensing the temperature of the generated heat;

controlling the generated heat to achieve an operating temperature by intermittently applying and releasing the power; and releasing a vacuum to fail the heating element if the generated heat exceeds the operating temperature by a predetermined amount.

8. The method of claim 7 wherein releasing the vacuum further comprises:

maintaining the vacuum with a bulb having an opening sealed by a melting agent; and releasing the vacuum by melting the melting agent if the generated heat exceeds the operating temperature by the predetermined amount.

9. The method of claim 8 wherein the melting agent comprises solder sealing an expansion port of the bulb, the solder having a melting point that exceeds the operating temperature by the approximately the predetermined amount.

10. The method of claim 7 wherein releasing the vacuum further comprises:

maintaining the vacuum with a bulb having an integrated expanding agent; and releasing the vacuum by fracturing the bulb with expansion of the expanding agent induced by generated heat that exceeds the operating temperature by the predetermined amount.

11. The method of claim 10 wherein the expanding agent comprises a ceramic integrated in a vacuum port of the bulb.

12. The method of claim 7 wherein controlling heat further comprises controlling heat to achieve an operating temperature associated with affixing printing material to a print media.

* * * * *